US007513223B2

(12) United States Patent
Onodera et al.

(10) Patent No.: US 7,513,223 B2
(45) Date of Patent: Apr. 7, 2009

(54) ENGINE-DRIVEN WORK MACHINE

(75) Inventors: Taiyo Onodera, Saitama (JP); Hitoshi Yuki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/791,014

(22) PCT Filed: Jan. 13, 2006

(86) PCT No.: PCT/JP2006/300346

§ 371 (c)(1),
(2), (4) Date: May 18, 2007

(87) PCT Pub. No.: WO2006/077773

PCT Pub. Date: Jul. 27, 2006

(65) Prior Publication Data

US 2008/0134996 A1 Jun. 12, 2008

(30) Foreign Application Priority Data

Jan. 20, 2005 (JP) ..... 2005-013321

(51) Int. Cl.
*F01P 1/02* (2006.01)

(52) U.S. Cl. ..... 123/41.7

(58) Field of Classification Search ..... 123/41.56, 123/41.6, 41.62, 41.7, 2–3, 41.55, 41.58
See application file for complete search history.

(56) References Cited

U.S. PATENT DOCUMENTS 5,121,715 A * 6/1992 Nogami et al. ..... 123/41.7
6,917,121 B2 * 7/2005 Akimoto et al. ..... 290/1 A
6,979,912 B2 * 12/2005 Mazuka et al. ..... 290/1 A
7,107,943 B2 * 9/2006 Yasuda et al. ..... 123/41.62
2008/0127912 A1 * 6/2008 Onodera et al. ..... 123/2

FOREIGN PATENT DOCUMENTS

| | | | |
|---|---|---|---|
| JP | 58-197415 | * | 11/1983 |
| JP | 59-74327 | A | 4/1984 |
| JP | 2-32836 | | 9/1990 |
| JP | 06-330762 | A | 11/1994 |
| JP | 2739184 | | 1/1998 |
| JP | 3061883 | U | 6/1999 |
| JP | 2002-30940 | A | 1/2002 |
| JP | 2002-240790 | A | 8/2002 |

* cited by examiner

*Primary Examiner*—Hai H Huynh
(74) *Attorney, Agent, or Firm*—Arent Fox LLP

(57) ABSTRACT

An engine-driven work machine is provided in which an engine/work machine unit (5) is housed in a box (30) and a cooling fan (15) for generating a flow of cooling air from an air inlet (39) to an air outlet (40) via the surroundings of the engine/work machine unit (5) is disposed within the box (30), wherein a gas/liquid separation chamber (32) for restricting the flow of cooling air is provided between the air inlet (39) and the engine/work machine unit (5), and the gas/liquid separation chamber (32) is provided with a first wall face (**32*a*1) for changing upward flow of cooling air into a lateral direction after it has collided with the first wall face (32*a*1) and a second wall face (32*a*2**) for changing the lateral direction of flow into an obliquely downward direction. This enables mist contained in cooling air taken into the box to be separated and removed effectively before the cooling air reaches the surroundings of the engine/generator unit.

5 Claims, 6 Drawing Sheets

ENGINE-DRIVEN WORK MACHINE

CROSS REFERENCE TO RELATED APPLICATION

This application is a National Stage entry of International Application No. PCT/JP 2006/300346, filed Jan. 13, 2006, the entire specification claims and drawings of which are incorporated herewith by reference.

TECHNICAL FIELD

The present invention relates to an improvement of an engine-driven work machine in which an engine/work machine unit is formed by joining an engine and a work machine driven by a crankshaft of the engine, the engine/work machine unit is housed in a box, an air inlet and an air outlet open on an outer face of the box, and a cooling fan for generating a flow of cooling air from the air inlet to the air outlet via the surroundings of the engine/work machine unit is disposed within the box.

BACKGROUND ART

Such an engine-driven work machine is already known as disclosed in, for example, Patent Publications 1 and 2.

Patent Publication 1: Japanese Utility Model Registration Publication No. 2-32836

Patent Publication 2: Japanese Patent No. 2739184

DISCLOSURE OF INVENTION

Problems to be Solved by the Invention

Such engine-driven work machines are widely used as engine-driven generators used as a power source for construction work, a power source for outdoor recreation, a power source for emergency use, etc. In this case, the box housing the engine/work machine unit prevents the running noise of the engine/work machine unit from leaking and enhances the quietness of the engine-driven work machine, and such engine-driven work machines have little influence on the surrounding environment even when running at night in an urban area.

In such conventional engine-driven work machines, since the amount, including cooling air, taken into the box is large, means for limiting as much as possible the entry of dust into the interior of the box by forming a labyrinth-like intake pathway or providing a large intake hood is provided. However, although such means is effective in limiting the entry of dust into the interior of the box, it cannot be said that it is always effective in suppressing the entry of mist generated in rainy weather.

It is an object of the present invention to provide an engine-driven generator that enables mist contained in cooling air taken into the box to be separated and removed effectively before the cooling air reaches the surroundings of the engine/generator unit.

Means for Solving the Problems

In order to attain the above object, according to a first aspect of the present invention, there is provided an engine-driven work machine in which an engine/work machine unit is formed by joining an engine and a work machine driven by a crankshaft of the engine, the engine/work machine unit is housed in a box, an air inlet and an air outlet open on an outer face of the box, and a cooling fan for generating a flow of cooling air from the air inlet to the air outlet via the surroundings of the engine/work machine unit is disposed within the box, characterized in that a gas/liquid separation chamber for restricting the flow of cooling air is provided between the air inlet and the engine/work machine unit, and the gas/liquid separation chamber is provided with a first wall face for changing an upward flow of cooling air into a lateral direction after the cooling air has collided with the first wall face, and a second wall face for changing the lateral direction of flow into an obliquely downward direction.

Further, according to a second aspect of the present invention, in addition to the first aspect, the gas/liquid separation chamber has a louver provided in a lower part as the air inlet, and the louver comprises a plurality of guide blades for restricting the direction of inflow of cooling air into the gas/liquid separation chamber so as to be obliquely upward toward the side opposite to the lateral direction.

Moreover, according to a third aspect of the present invention, in addition to the first or second aspect, the gas/liquid separation chamber is formed from a first chamber having the first wall face and the second wall face and a second chamber rising from an end part of the first chamber on the downstream side, the first chamber and the second chamber communicate via a constricted opening, the second chamber is provided with a third wall face for making cooling air that has passed through the constricted opening collide therewith, and the third wall face has a canopy-shaped water droplet trap projectingly provided at a position higher than the constricted opening.

Furthermore, according to a fourth aspect of the present invention, in addition to the third aspect, the second chamber has a drain hole provided in a lower part directly below the water droplet trap.

It should be noted here that the work machine corresponds to a generator 4 of an embodiment of the present invention, which will be described later. The first, second, and third wall faces correspond to a horizontal wall face 32*a*1, an inclined wall face 32*a*2, and a vertical wall face 32*b*1 of the embodiment, and the first and second chambers correspond to a horizontal chamber 32*a* and a horizontal chamber 32*b* of the embodiment.

Effects of the Invention

In accordance with the first aspect of the present invention, when cooling air that contains mist flows into the gas/liquid separation chamber, since the cooling air is made to collide with the first wall face, mist becomes attached to the first wall face, turns into water droplets, and falls. Since the lateral flow of cooling air along the first wall face is subsequently changed obliquely downward by the second wall face, mist remaining in the cooling air turns into water droplets and is thrown off downward. In this way, mist is efficiently separated from the cooling air, and the engine/generator unit can be cooled by cooling air that contains no mist or very little mist.

Furthermore, in accordance with the second aspect of the present invention, cooperation between the louver and the first wall face gives a large change in direction to the flow of cooling air so that it makes a U-turn in the gas/liquid separation chamber, thus enhancing the effect in separating mist.

Moreover, in accordance with the third aspect of the present invention, when cooling air moves from the first chamber to the second chamber, it collides forcefully with the third wall face of the second chamber as a result of the flow rate being increased by the constricted opening, and mist remaining in the cooling air thereby becomes attached to the third wall face, turns into water droplets, and falls. Even if water droplets attached to the third wall face are guided upward by ascending cooling air, they are captured by the water droplet trap, are decelerated, and fall. In this way, remaining mist can be removed efficiently from the cooling air.

Furthermore, in accordance with the fourth aspect of the present invention, water droplets that fall from the water droplet trap or the third wall face of the second chamber facing the constricted opening can be discharged quickly to the outside via the drain hole.

EXPLANATION OF REFERENCE NUMERALS AND SYMBOLS

Figure 1:
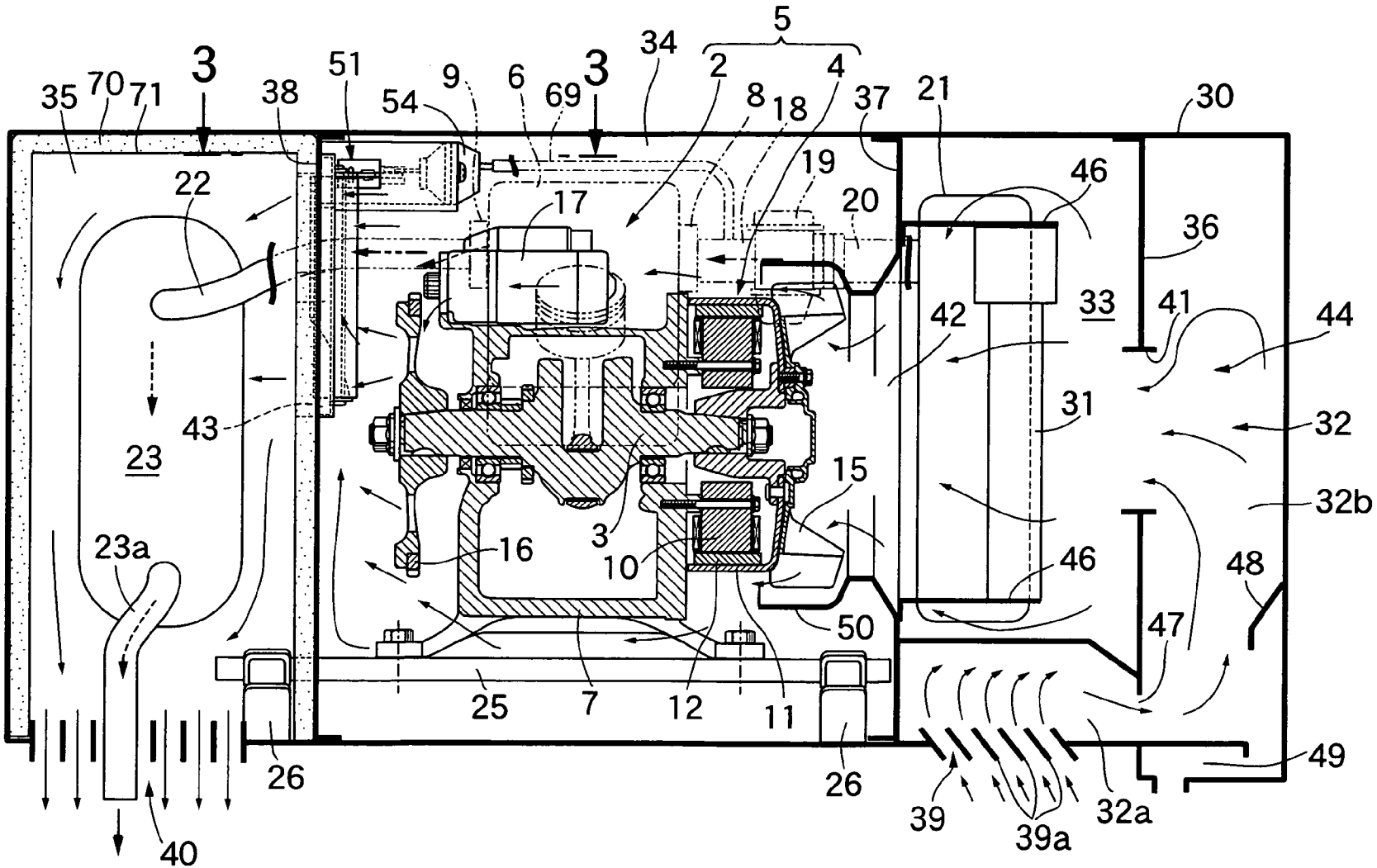
FIG. 1 is a vertical sectional front view of an engine-driven generator related to the present invention (first embodiment).

1 Engine-driven work machine (engine-driven generator)
2 Engine
3 Crankshaft
4 Work machine (generator)
5 Engine/work machine unit
15 Cooling fan
32 Gas/liquid separation chamber
32*a* First chamber (horizontal chamber)
32*a*1 First wall face
32*a*2 Second wall face
32*b* Second chamber (vertical chamber)
32*b*1 Third wall face
39 Air inlet (air inlet louver)
40 Air outlet (air outlet louver)
47 Constricted opening
48 Water droplet trap
49 Drain hole

BEST MODE FOR CARRYING OUT THE INVENTION

A mode for carrying out the present invention is explained by reference to a preferred embodiment of the present invention shown in the drawings.

EMBODIMENT 1

First, in FIG. 1, an engine-driven generator 1 as an engine-driven work machine includes an engine/work machine unit 5 formed by joining an engine 2 and a generator 4 driven by a crankshaft 3 of the engine 2. The engine 2 is a 4 cycle type, a cylinder portion 6 thereof projects obliquely upward toward one side from a crankcase 7 housing and supporting the crankshaft 3, and an intake port 8 and an exhaust port 9 open on a right-hand side face and a left-hand side face respectively of the cylinder portion 6.

The generator 4 is formed from a stator 10 fixed to a right-hand side face of the crankcase 7 and a bottomed cylindrical outer rotor 11 fixed to a right-hand end portion of the crankshaft 3 extending through a right-hand side wall of the crankcase 7, and the outer rotor 11 includes a plurality of permanent magnets 12 fixed to an inner peripheral face thereof and arranged in the peripheral direction. This generator 4 is therefore a so-called magnet outer rotor multi-pole generator. The outer rotor 23 has a centrifugal cooling fan 15 mounted on an outer end face thereof, the cooling fan 15 having a larger diameter than that of the outer rotor 23. A ring gear 16 is fixed to a left-hand end portion of the crankshaft 3, and a starter motor 17 is mounted on the crankcase 7 or the cylinder portion 6, the starter motor 17 being capable of cranking the crankshaft 3 via the ring gear 16.

A carburetor 19 is mounted on a right-hand side face of the cylinder portion 6 via an intake pipe 18 communicating with the intake port 8, and an air cleaner 21 is connected to an intake path entrance of the carburetor 19 via an intake duct 20. An exhaust muffler 23 is connected to a left-hand side face of the cylinder portion 6 via an exhaust pipe 22 communicating with the exhaust port 9.

The crankcase 7 of the engine 2 is supported on an engine bed 25, and this engine bed 25 is supported on a machine stand 26 via an elastic member, which is not illustrated. The engine 2, the generator 4, the carburetor 19, the air cleaner 21, and the exhaust muffler 23 are housed in a rectangular parallelepiped box 30, and a bottom wall of this box 30 is joined to the machine stand 26. An electrical component 31 (e.g. an inverter) for controlling the output of the generator 4 is disposed adjacent to the air cleaner 21.

The box 30 is equipped with first to third dividing walls 36 to 38, which compartmentalize the interior of the box 30 into a gas/liquid separation chamber 32 for taking in outside air and separating water droplets, etc. from the outside air, an electrical component chamber 33 having the electrical component 31 and the air. cleaner 21 disposed therein, a unit chamber 34 having the engine/work machine unit 5 disposed therein, and a muffler chamber 35 having the exhaust muffler 23 disposed therein. An air inlet louver 39 is provided in a bottom wall of the gas/liquid separation chamber 32. The first dividing wall 36 is provided with a first communicating opening 41 providing communication between the gas/liquid separation chamber 32 and the electrical component chamber 33, the second dividing wall 37 is provided with a second communicating opening 42 providing communication between the electrical component chamber 33 and the unit chamber 34, and the third dividing wall 38 is provided with a third communicating opening 43 providing communication between the unit chamber 34 and the muffler chamber 35. An air outlet louver 40 is provided in a bottom wall of the muffler chamber 35, and a tail pipe 23*a* of the exhaust muffler 23 is disposed so as to run through the air outlet louver 40.

The air inlet louver 39, the gas/liquid separation chamber 32, the first communicating opening 41, the electrical component chamber 33, the second communicating opening 42, the unit chamber 34, the third communicating opening 43, the muffler chamber 35, and the air outlet louver 40 thereby form a cooling air passage 44 running around the electrical component 31, the engine/work machine unit 5, and the exhaust muffler 23.

The electrical component 31 is supported by a pair of upper and lower stays 46 and 46 which are made to project from the second dividing wall 37 toward the electrical component chamber 33 side. In this arrangement, the electrical component 31 is disposed with a fixed spacing from the first dividing wall 36 so as not to block the first communicating opening 41. The intake duct 20, which provides communication between the air cleaner 21 and the carburetor 19, runs through the first dividing wall 36.

Figure 2:
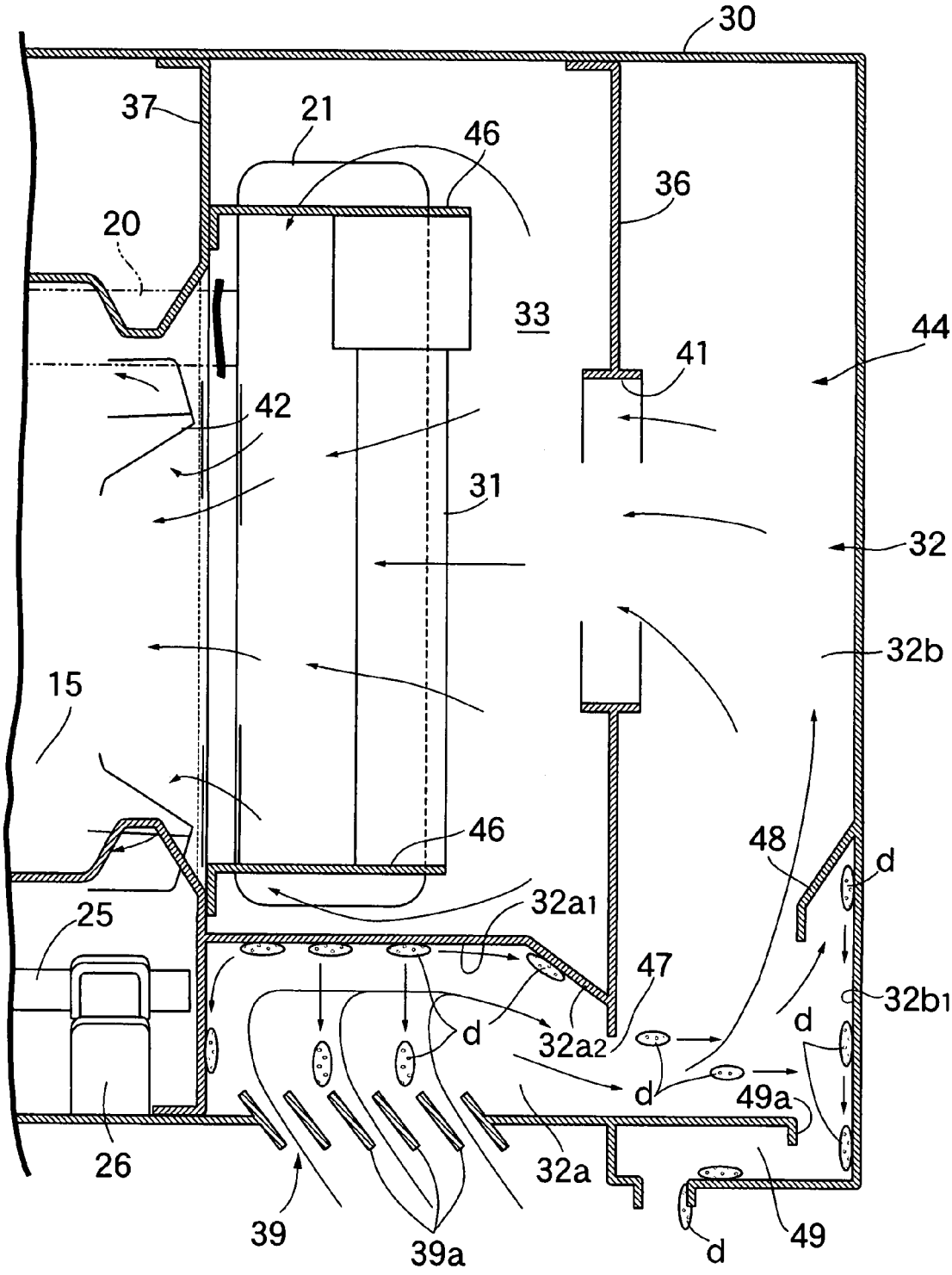
FIG. 2 is an enlarged view of the area around a cooling air intake opening in FIG. 1 (first embodiment).

As is clearly shown in FIG. 2, the gas/liquid separation chamber 32 is formed from a horizontal chamber 32*a*, which has the air inlet louver 39 in its bottom wall and extends horizontally, and a vertical chamber 32*b*, which rises from a right-hand end part of the horizontal chamber 32*a*, and the horizontal chamber 32*a* and vertical chamber 32*b* communicate via a constricted opening 47. The vertical chamber 32*b* communicates with the electrical component chamber 33 via the first communicating opening 41.

The air inlet louver 39, which is provided in the bottom wall of the horizontal chamber 32*a*, includes a plurality of guide blades 39*a* for directing air that is taken into the horizontal chamber 32*a* in a direction opposite to that of the vertical chamber 32*b*. A horizontal wall face 32*a*1 on the ceiling side of the horizontal chamber 32*a* is formed relatively low so that air that has passed through the air inlet louver 39 collides with the horizontal wall face 32*a*1, and an end portion of the horizontal wall face 32*a*1 that is adjacent to the constricted opening 47 is formed as an inclined wall face 32*a*2, which is inclined toward the constricted opening 47.

Furthermore, a vertical wall face 32*b*1 of the vertical chamber 32*b* that faces the constricted opening 47 is disposed relatively close to the constricted opening 47 so that air that has passed through the constricted opening 47 collides with the vertical wall face 32*b*1, and the vertical wall face 32*b*1 is equipped with a water droplet trap 48, which projects in a canopy shape in a middle section between the constricted opening 47 and the first communicating opening 41. A drain hole 49 is formed in the bottom wall of the vertical chamber 32*b*, the drain hole 49 bending in a labyrinth shape and opening on the lower face of the box 30 and, in particular, an opening 49*a* of this drain hole 49 to the vertical chamber 32*b* is disposed directly below the water droplet trap 48.

Referring again to FIG. 1, the second dividing wall 37 has a fan cover 50 provided so as to be connected thereto, the fan cover 50 extending from the peripheral edge of the second communicating opening 42 and covering the outer periphery of the cooling fan 15, and the cooling fan 15 guiding to the outer periphery of the engine/work machine unit 5 air that has been taken in via the first communicating opening 41.

Figure 3:
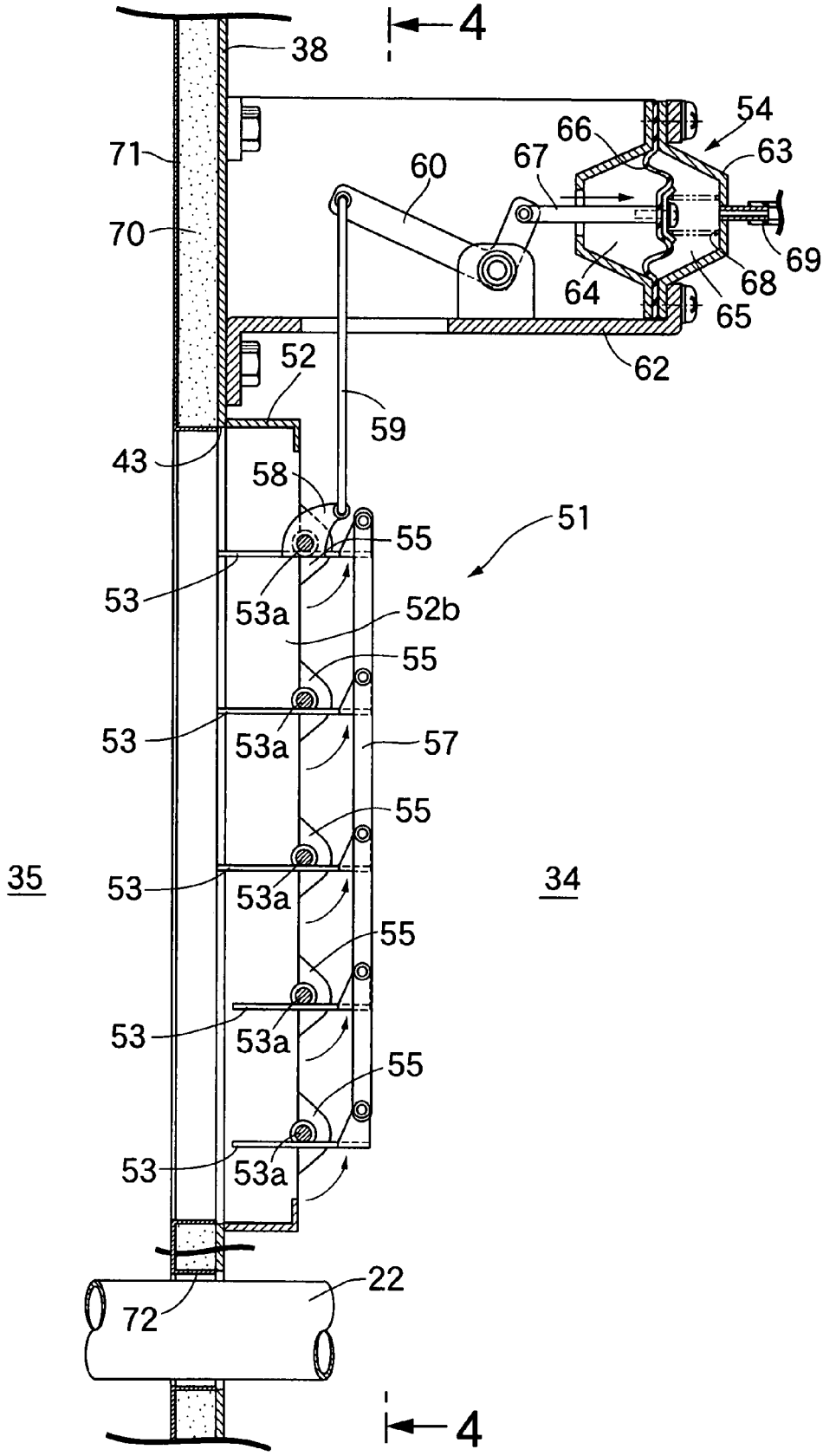
FIG. 3 is an enlarged sectional view along line 3-3 in FIG. 1 (showing blocking means in an open state) (first embodiment).
Figure 4:
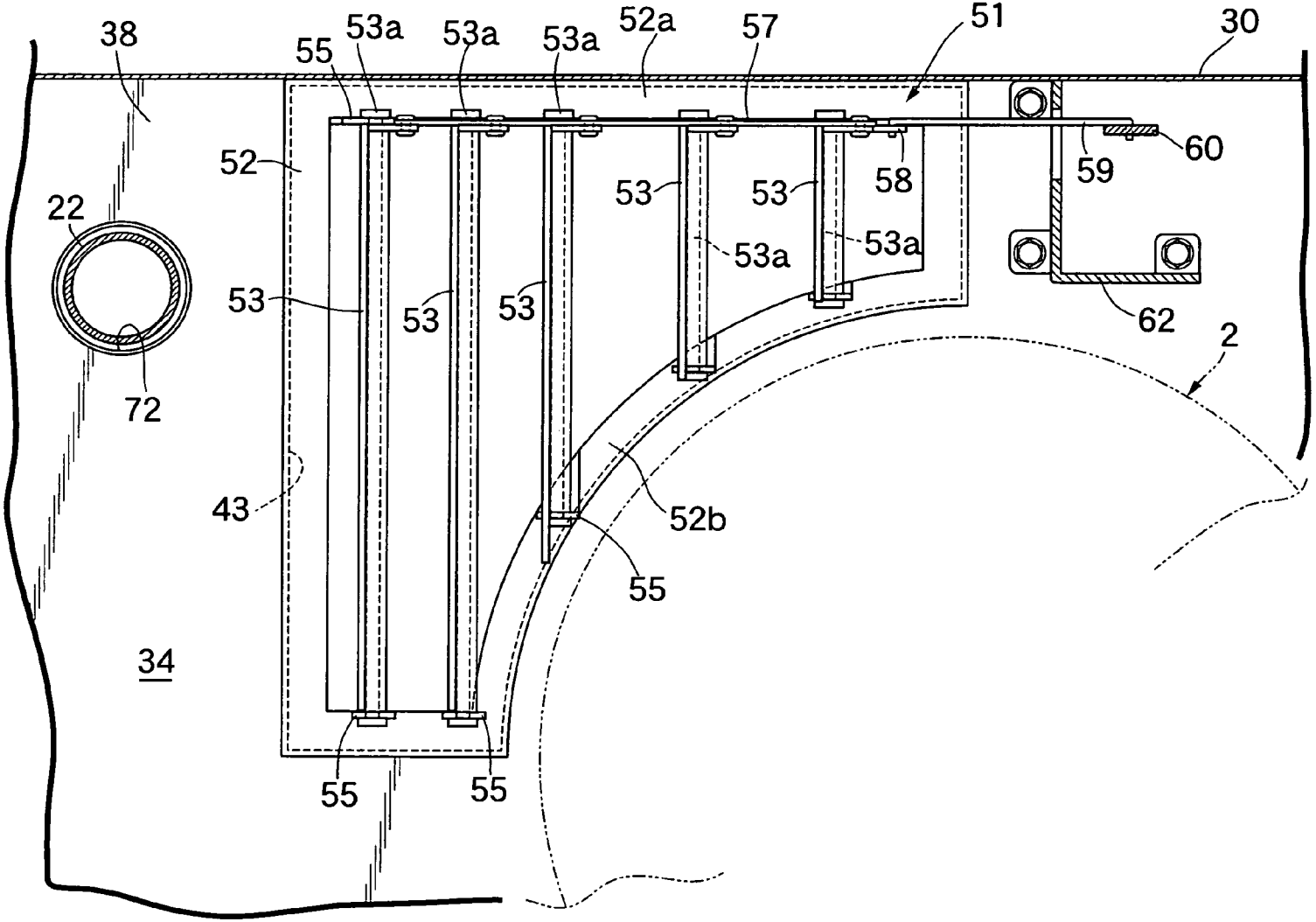
FIG. 4 is a sectional view along line 4-4 in FIG. 3 (first embodiment).

In FIG. 1, FIG. 3, and FIG. 4, the third dividing wall 38 is provided with blocking means 51 for closing the third communicating opening 43. This blocking means 51 is formed from a frame body 52 mounted on the third dividing wall 38 so as to surround the third communicating opening 43 on the unit chamber 34 side, a plurality of valve plates 53 axially supported on the frame body 52 so as to open and close, and an actuator 54 disposed in the unit chamber 34 so as to make the valve plates 53 open and close. Each of the valve plates 53 includes a valve shaft 63*a* rotatably supported by a pair of upper and lower brackets 55 and 55 formed on an upper frame 52*a* and a lower frame 52*b* of the frame body 52, and all the valve plates 53 are connected to one common synchronous link 57 for synchronizing opening and closing operations.

Among the plurality of valve plates 53, the outermost valve plate 53 has an operating arm 58 formed on one end part, and the actuator 54 is coupled to this operating arm 58 via a link 59 and a bellcrank 60.

The actuator 54 is formed from a shell 63 fixedly supported by a stay 62 secured to the third dividing wall 38 in the unit chamber 34, a diaphragm 66 that compartmentalizes the interior of the shell 63 into an atmospheric chamber 64 on the bellcrank 60 side and a negative pressure operating chamber 65 on the opposite side, an operating rod 67 connected to a central part of the diaphragm 66, running through the atmospheric chamber 64, and projecting outside the shell 63, and a return spring 68 housed in the negative pressure operating chamber 65 and urging the diaphragm 66 toward the atmospheric chamber 64 side. The atmospheric chamber 64 is open to the atmosphere, the negative pressure operating chamber 65 communicates with the interior of the intake pipe 18 via a negative pressure guide tube 69, and while the engine 2 is running intake negative pressure is introduced into the negative pressure operating chamber 65.

The bellcrank 60 is axially supported by the stay 62, has the operating rod 67 connected to one end, and has the other end connected to the operating arm 58 via the link 59.

Figure 5:
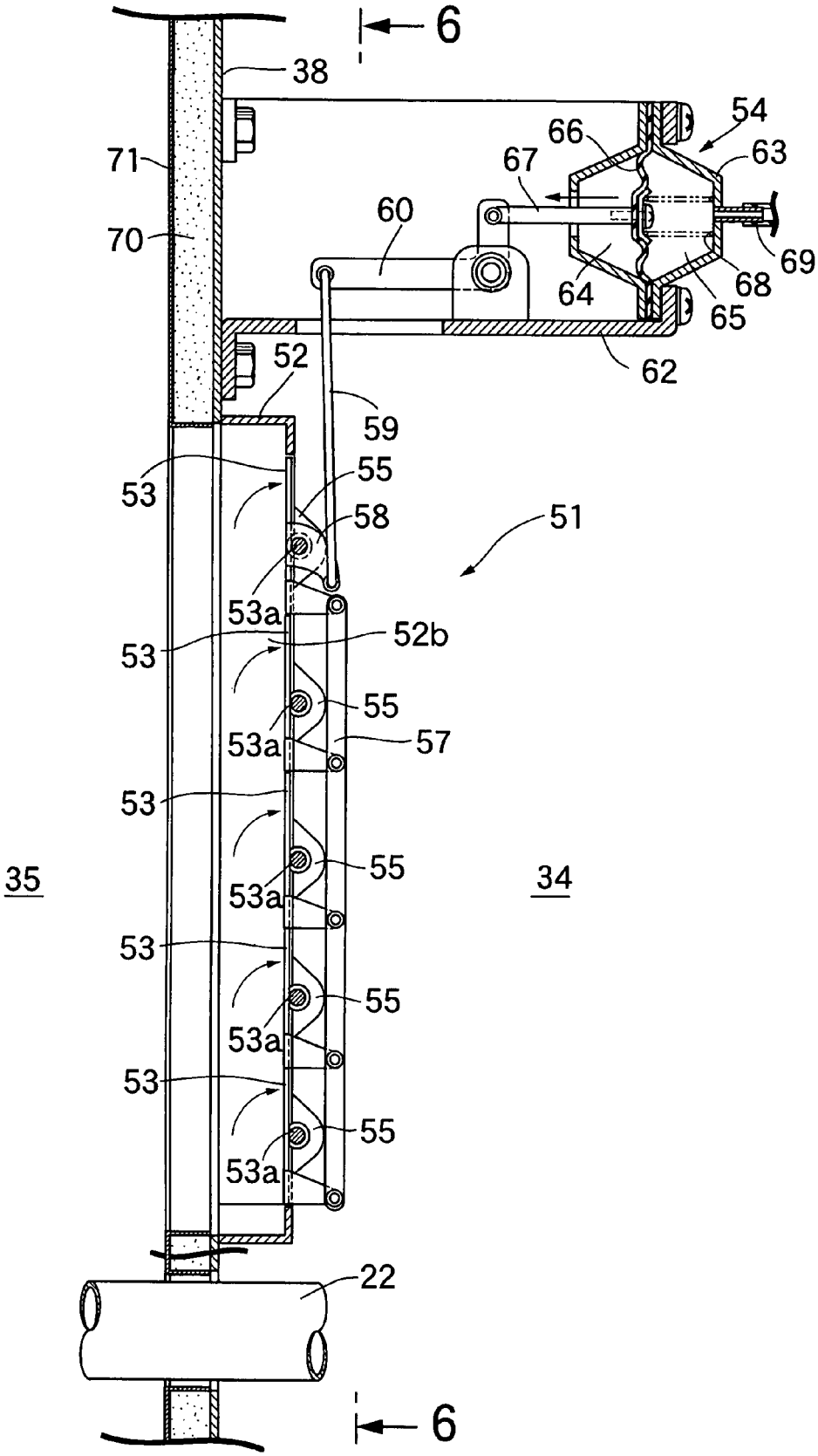
FIG. 5 is a view, corresponding to FIG. 3, showing the blocking means in a blocking state (first embodiment).

While the engine 2 is running, when the intake negative pressure generated within the intake pipe 18 is introduced into the negative pressure operating chamber 65, the negative pressure acts so as to displace the diaphragm 66 toward the negative pressure operating chamber 65 side and pull the operating rod 67, this pulling force is transmitted to the operating arm 58 via the bellcrank 60 and the link 59, and by pivoting the operating arm 58 in an anticlockwise direction as shown in FIG. 3 all the valve plates 53 open simultaneously. When running of the engine 2 is stopped, the intake negative pressure disappears from the intake pipe 18 and the intake path of the carburetor 19; since the negative pressure of the negative pressure operating chamber 65 is also lost, the diaphragm 66 therefore pushes out the operating rod 67 by means of the urging force of the return spring 68, this pushing force is transmitted to the operating arm 58 via the bellcrank 60 and the link 59, and by pivoting the operating arm 58 in a clockwise direction as shown in FIG. 5 all the valve plates 53 are closed simultaneously.

As shown in FIG. 1 and FIG. 3, a heat-insulating layer 70 made of a heat-insulating material such as glass wool is bonded to the entire inner face of the muffler chamber 35, and the entire inner face of the heat-insulating layer 70 is covered with a thermally conductive body 71 made of aluminum foil, etc.

The exhaust pipe 22 is arranged so as to run through a series of through holes 72 provided in the third dividing wall 38, the heat-insulating layer 70, and the thermally conductive body 71.

The operation of this embodiment is now explained.

When the engine 2 is run, air that has been filtered by the air cleaner 21 within the electrical component chamber 33 and that is accompanied by fuel in the carburetor 19 is taken into the engine 2 through the intake pipe 18. The intake negative pressure generated within the intake pipe 18 due to the above intake action of the engine 2 is transmitted to the negative pressure operating chamber 65 of the actuator 54 via the negative pressure guide tube 69, and the diaphragm 66 pulls the operating rod 67 as described above to thus open all the valve plates 53 simultaneously and thereby open the third communicating opening 43 (see FIG. 3 and FIG. 4). The cooling air passage 44 from the air inlet louver 39 to the air outlet louver 40 therefore attains an open state.

Since the crankshaft 3 of the engine 2 rotates the outer rotor 11 of the generator 4 and the cooling fan 15 simultaneously, the generator 4 attains a generating state, and the power thus generated is taken out to the outside via a control panel (not illustrated). The rotating cooling fan 15 takes in outside air as cooling air from the air inlet louver 39 via the gas/liquid separation chamber 32, the first communicating opening 41, the electrical component chamber 33, and the second communicating opening 42, and as shown by arrows makes it pass in sequence through the unit chamber 34, the third communicating opening 43, and the muffler chamber 35, and makes it flow to the outside via the air outlet louver 40. In this process, in sequence, the electrical component 31 is cooled by cooling air passing through the electrical component chamber 33, the engine 2 and the generator 4 are cooled by cooling air passing through the unit chamber 34, and the exhaust muffler 23 is cooled by cooling air passing through the muffler chamber 35.

Moreover, since the engine 2, the generator 4, the cooling fan 15, the exhaust muffler 23, etc. are entirely covered by the box 30, running noise generated therefrom can be blocked effectively by the box 30, and quietness can be achieved for the engine-driven generator 1.

When it is raining or there is a dense fog, mist might be taken into the air inlet louver 39 together with the cooling air, and the mist is separated and removed from the cooling air by the gas/liquid separation chamber 32 as follows.

That is, when mist-containing cooling air first flows via the air inlet louver 39 into the horizontal chamber 32*a* of the gas/liquid separation chamber 32, since the cooling air is directed obliquely upward in a direction opposite to the vertical chamber 32*b* by means of the plurality of guide blades 39*a* of the louver 39, after colliding with the horizontal wall face 32*a*1 on the ceiling, the flow of cooling air undergoes a large change in direction so as to make a U-turn toward the vertical chamber 32*b* along the horizontal wall face 32*a*1, the mist contained in the cooling air is centrifugally separated from the cooling air due to a difference in specific gravity, becomes attached to the horizontal wall face, and falls down as water droplets d. Subsequently, horizontal flow of the cooling air along the horizontal wall face 32*a*1 is changed obliquely downward by the inclined wall face 32*a*2, and mist remaining in the cooling air turns into water droplets, which are thrown off downward and separated.

Furthermore, since, when the cooling air moves from the horizontal chamber 32*a* to the vertical chamber 32*b* via the constricted opening 47, its flow is accelerated by means of the constricted opening 47, the cooling air collides forcibly with the vertical wall face 32*b*1 of the vertical chamber 32*b*, and mist remaining in the cooling air becomes attached to the vertical wall face 32*b*1, turns into water droplets d, and falls down. Furthermore, even if water droplets d attached to the vertical wall face 32*b*1 are guided upward by the ascending cooling air, they are captured by the water droplet trap 48, are decelerated, and fall.

The water droplets d that have fallen from the vertical wall face 32*b*1 and the water droplet trap 48 quickly flow out to the outside via the drain hole 49 directly below the water droplet trap 48.

Since mist can thus be separated from cooling air efficiently and the electrical component 31, the engine 2, the generator 4, and the exhaust muffler 23 can be cooled by cooling air that contains no mist or very little mist, it is possible to prevent mist from affecting the electrical component 31, the engine 2, the generator 4, and the exhaust muffler 23, and it is also possible for the engine 2 to take in through the air cleaner 21 air that contains no mist or very little mist. Furthermore, since both the air inlet louver 39 and the air outlet louver 40 are mounted on the bottom wall of the box 30, it is possible to easily prevent rain from entering these louvers 39 and 40.

Figure 6:
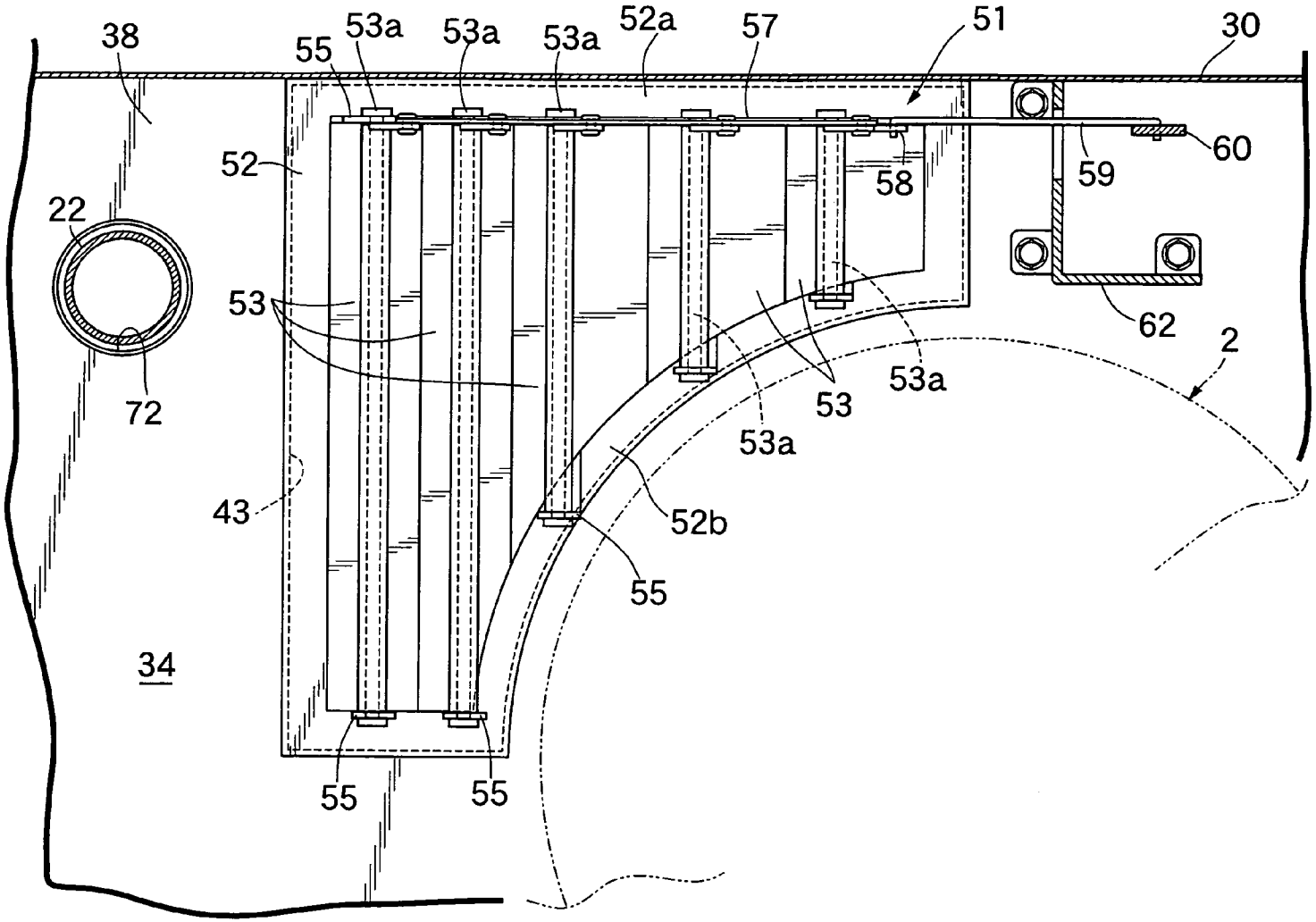
FIG. 6 is a sectional view along line 6-6 in FIG. 5 (first embodiment).

When running of the engine 2 is stopped, the intake negative pressure within the intake pipe 18 disappears, negative pressure of the negative pressure operating chamber 65 of the actuator 54 also disappears, and as described above the diaphragm 66 pushes out the operating rod 67 by means of the urging force of the return spring 68 so as to close all the valve plates 53 simultaneously, thus closing the third communicating opening 43 (see FIG. 5 and FIG. 6). This allows communication between the unit chamber 34 and the muffler chamber 35 to be blocked. By allowing the high temperature exhaust muffler 23 to stand and gradually cool in the muffler chamber 35 the heat of the exhaust muffler 23 can be prevented from affecting the engine/work machine unit 5 or the outer face of the box 30 and, moreover, since it is unnecessary for the air outlet to be large or to open upward, it is possible to ensure that the box 30 is soundproof.

In particular, since the heat-insulating layer 70, which is made of a heat-insulating material such as glass wool, is bonded to the entire inner face of the muffler chamber 35, and the entire inner face of the heat-insulating layer 70 is covered with the thermally conductive body 71, which is made of aluminum foil, etc., radiant heat that the thermally conductive body 71 receives from the exhaust muffler 23 is dispersed throughout the heat-insulating layer 70, thus preventing the heat-insulating layer 70 from being locally overheated, and the entire heat-insulating layer 70 cools gradually, thus promoting equal and gradual cooling of the entire muffler chamber 35, and thereby reliably preventing heat of the exhaust muffler 23 from affecting the engine/work machine unit 5 or the outer face of the box 30.

Furthermore, since the valve plates 53 are opened and closed by putting the actuator 54 in an operative or inoperative state according to the presence or absence of intake negative pressure of the engine 2, it is possible to automatically control the open and closed states of the valve plates 53 according to whether the engine 2 is running or is stopped.

The present invention is not limited to the above-mentioned embodiment, and may be modified in a variety of ways as long as the modifications do not depart from the spirit and scope thereof. For example, the actuator 54 may be formed as an electromagnetic type in which its operation is controlled by a switch that detects the presence or absence of intake negative pressure of the engine 2.

The invention claimed is:

1. An engine-driven work machine in which an engine/work machine unit is formed by joining an engine and a work machine driven by a crankshaft of the engine, the engine/work machine unit is housed in a box, an air inlet and an air outlet are open on an outer face of the box, and a cooling fan for generating a flow of cooling air from the air inlet to the air outlet via surroundings of the engine/work machine unit is disposed within the box, wherein a gas/liquid separation chamber for restricting the flow of cooling air is provided between the air inlet and the engine/work machine unit, and the gas/liquid separation chamber comprises a horizontal chamber in communication with the air inlet and a vertical chamber connected to the horizontal chamber, an electrical component chamber is provided in the box between the engine/work machine unit and the vertical chamber of the gas/liquid separation chamber, said horizontal chamber being positioned below the electrical component chamber, said gas/liquid separation chamber being provided with a first wall face for defining the horizontal chamber and changing an upward flow of cooling air into a lateral direction after the cooling air has been taken from the air inlet into the horizontal chamber and collided with the first wall face, and a second wall face for changing the lateral direction of flow into an obliquely downward direction and guiding the cooling air into the vertical chamber, and wherein the cooling air in the vertical chamber flows into the electrical component chamber and then towards the engine/work machine unit in a direction opposite the direction of cooling air flowing from the horizontal chamber to the vertical chamber.

2. The engine-driven work machine according to claim 1, wherein the gas/liquid separation chamber has a louver provided in a lower part as the air inlet, and the louver comprises a plurality of guide blades for restricting the direction of inflow of cooling air into the gas/liquid separation chamber so as to be obliquely upward toward the side opposite to said lateral direction.

3. The engine-driven work machine according to claim 1 or 2, wherein the horizontal chamber and the vertical chamber communicate via a constricted opening, the vertical chamber is provided with a third wall face for making cooling air that has passed through the constricted opening collide therewith, and the third wall face has a canopy-shaped water droplet trap projectingly provided at a position higher than the constricted opening.

4. The engine-driven work machine according to claim 3, wherein the vertical chamber has a drain hole provided in a lower part directly below the water droplet trap.

5. The engine-driven work machine according to claim 1, wherein the engine-driven work machine is a generator.

* * * * *